US011242793B2

(12) United States Patent
Barret et al.

(10) Patent No.: US 11,242,793 B2
(45) Date of Patent: Feb. 8, 2022

(54) MUFFLER ASSEMBLY UNIT

(71) Applicant: Eberspächer Exhaust Technology GmbH & Co. KG, Neunkirchen (DE)

(72) Inventors: Ian Barret, Stuttgart (DE); Laurent Cazeneuve, Saint Rémy l'Honoré (FR)

(73) Assignee: PUREM GMBH, Neunkirchen (DE)

( * ) Notice: Subject to any disclaimer, the term of this patent is extended or adjusted under 35 U.S.C. 154(b) by 424 days.

(21) Appl. No.: 16/249,258

(22) Filed: Jan. 16, 2019

(65) Prior Publication Data

US 2019/0226384 A1 Jul. 25, 2019

(30) Foreign Application Priority Data

Jan. 19, 2018 (DE) ..... 10 2018 101 139.3

(51) Int. Cl.

| | |
|---|---|
| ***F01N 13/14*** | (2010.01) |
| ***F01N 13/18*** | (2010.01) |
| *F01N 1/24* | (2006.01) |
| *F01N 13/08* | (2010.01) |
| *G10K 11/162* | (2006.01) |

(52) U.S. Cl.

CPC ..... *F01N 13/141* (2013.01); *F01N 13/143* (2013.01); *F01N 13/1877* (2013.01); *F01N 13/1888* (2013.01); *F01N 1/24* (2013.01); *F01N 13/08* (2013.01); *F01N 2260/02* (2013.01); *F01N 2260/022* (2013.01); *F01N 2260/20* (2013.01); *G10K 11/162* (2013.01)

(58) Field of Classification Search

CPC ..... F01N 13/141; F01N 13/143; F01N 2260/022; F01N 2260/20

See application file for complete search history.

(56) References Cited

U.S. PATENT DOCUMENTS

| | | | | |
|---|---|---|---|---|
| 4,029,167 | A * | 6/1977 | Fox | B60K 13/04 180/309 |
| 4,265,332 | A * | 5/1981 | Presnail | F01N 13/082 181/211 |
| 4,609,067 | A | 9/1986 | Gonwa | |
| 5,183,130 | A | 2/1993 | Nakamura et al. | |
| 5,482,681 | A | 1/1996 | Sager, Jr. | |
| 6,435,272 | B1 | 8/2002 | Voss | |
| 2010/0176573 | A1* | 7/2010 | Melton | F01N 13/14 280/304.3 |
| 2016/0233739 | A1* | 8/2016 | Jenison | F02B 63/044 |

FOREIGN PATENT DOCUMENTS

| | | | |
|---|---|---|---|
| CN | 102191983 | A | 9/2011 |
| CN | 203604012 | U | 5/2014 |
| CN | 205225380 | U | 5/2016 |
| CN | 106368786 | A | 2/2017 |
| CN | 106917656 | A | 7/2017 |
| CN | 107060971 | A | 8/2017 |

(Continued)

*Primary Examiner* — Jonathan R Matthias

(74) *Attorney, Agent, or Firm* — McGlew and Tuttle, P.C.

(57) ABSTRACT

A muffler assembly unit for an exhaust system of an internal combustion engine, especially in a vehicle, includes a muffler (42) with a muffler housing (10). The muffler housing (10) is elongated along a longitudinal axis of the housing. A housing jacket (40) encloses the muffler housing (10). At least one air guiding bulge (34) is provided on the housing jacket (40).

18 Claims, 4 Drawing Sheets

(56) References Cited

FOREIGN PATENT DOCUMENTS

| | | | |
|---|---|---|---|
| CN | 107109980 | A | 8/2017 |
| DE | 36 25 814 | A1 | 2/1988 |
| DE | 10 2016 113 301 | A1 | 1/2017 |
| EP | 2 573 339 | A1 | 3/2013 |
| WO | 01/31176 | A1 | 5/2001 |

* cited by examiner (STATE OF THE ART)

(STATE OF THE ART)

(STATE OF THE ART)

MUFFLER ASSEMBLY UNIT

CROSS REFERENCE TO RELATED APPLICATIONS

This application claims the benefit of priority under 35 U.S.C. § 119 of German Application 10 2018 101 139.3, filed Jan. 19, 2018, the entire contents of which are incorporated herein by reference.

TECHNICAL FIELD

The invention pertains to a muffler assembly unit for an exhaust system of an internal combustion engine, especially in a vehicle.

BACKGROUND

A muffler housing 10 shown in FIGS. 1-3, which comprises a circumferential wall 12 elongated in the direction of a housing longitudinal axis L and a front wall 18, 20 each at both axial end areas 14, 16 of the circumferential wall 12, is known from DE 10 2016 113 301 A1. A separate body 21 providing an air guiding bulge 34 is connected to the circumferential wall 12 in the embodiment shown in FIG. 1.

In the embodiment shown in FIGS. 2 and 3, the circumferential wall 12 is formed by a sheet metal body 22 wound into a roll. A circumferential end area 24 of the sheet metal body 22 is connected to the length area 26 of the sheet metal body 22, overlapping this sheet metal body, by means of a weld seam 28 extending in the direction of the housing longitudinal axis L where the roll is closed in the circumferential direction. The sheet metal body 22 extends with this length area 26 in the circumferential direction beyond the weld seam 28 and is, as shown in FIG. 3, connected with its other circumferential end area 30 in a circumferential area offset to the weld seam 28, for example, by means of a plurality of welding spots 32 to the circumferential wall 12 provided by the sheet metal body 22. The length area 26 of the sheet metal body 22 forms an air guiding bulge 34 acting like a spoiler between the weld seam 28 and the circumferential end area 30.

If a muffler configured with such a muffler housing 10 is used in an exhaust system running under a vehicle underbody, then the air guiding bulge can establish a connection to adjacent assembly units of a vehicle, so that air flowing around the exhaust system is guided along the underside of a vehicle defined by the air guiding action of such an air guiding bulge and thus, on the one hand, the generation of air flow noises can be avoided and, on the other hand, improved aerodynamic conditions can be achieved in the area of the underbody. This effect then especially clearly comes into play when a muffler which is configured with such a muffler housing is installed as a rear muffler in the end area of an exhaust system with the housing longitudinal axis obliquely to the longitudinal direction of the vehicle.

SUMMARY

An object of the present invention is to provide a muffler assembly unit for an exhaust system of an internal combustion engine, with which an improved air guiding characteristic can be achieved by a configuration that is simple to achieve.

According to the present invention, this object is accomplished by a muffler assembly unit for an exhaust system of an internal combustion engine, especially in a vehicle, comprising:

a muffler with a muffler housing elongated along a housing longitudinal axis, a housing jacket enclosing the muffler housing, wherein at least one air guiding bulge is provided on the housing jacket.

In a departure from the arrangement known from the state of the art, the present invention provides a structural separation of the muffler configured with the muffler housing, on the one hand, and of the housing jacket provided for providing at least one air guiding bulge, on the other hand. Both the muffler or muffler housing, on the one hand, and the housing jacket, on the other hand, can thus essentially be provided regardless of the configuration of each other component with regard to the functionalities to be fulfilled by these two essential components of the muffler assembly unit according to the present invention. A robust design is obtained with the configuration according to the present invention, in which stability problems triggered especially in the area of an air guiding bulge, e.g., also due to corrosion, as they may occur in the state of the art especially where the length area of the sheet metal body forming the air guiding bulge is welded onto the circumferential wall, are avoided.

The muffler housing may comprise a circumferential wall elongated in the direction of the longitudinal axis of the housing and a front wall at both axial end areas of the circumferential wall and that the housing jacket fully enclose the circumferential wall in at least one length area of same for an especially stable configuration.

In order to be able to utilize the housing jacket as freely as possible for providing at least one air guiding bulge, the housing jacket may fully enclose the circumferential wall essentially in its entire length area, or/and that the housing jacket overlap at least one front wall, preferably both front walls.

In order to be able to enclose the muffler with the housing jacket in a simple manner, it is proposed that the housing jacket comprise at least two jacket shells connected to one another, wherein at least one air guiding bulge is provided on at least one jacket shell.

For a configuration that is easy to manufacture and yet guarantees a stable connection, the jacket shells may be connected to one another preferably by positive locking or/and by connection in substance in connecting edge areas adjoining one another, or/and at least one jacket shell may be connected, preferably by connection in substance, to the muffler housing.

In order to allow different thermal expansions of the muffler housing, on the one hand, and of the housing jacket, on the other hand, it is proposed that the housing jacket be permanently connected to the muffler housing only in one connecting length area, preferably essentially in the area of a longitudinal center in the direction of the housing longitudinal axis of the muffler housing and not be permanently connected to the muffler housing starting from the connecting length area in the direction towards the axial end areas of same.

Furthermore, for a stable positioning, the housing jacket can be supported on the muffler housing in at least one, preferably rib-like (rib) support area. It should be pointed out that the housing jacket is not fixed on the muffler housing against relative movement especially in the direction of the housing longitudinal axis in such a support area.

In order to be able to achieve an as tight as possible enclosing with the housing jacket even in case of the complicated shape of the muffler housing, it is proposed that the muffler housing have at least one housing bulge, and that the housing jacket have a receiving opening or/and a receiving bulge receiving this housing bulge in at least some areas in association with at least one housing bulge.

The flow of exhaust gas through the muffler can be guaranteed in an especially simple manner by at least one exhaust gas pipe projecting from the muffler housing, and by the housing jacket having an exhaust gas pipe passage opening in the area of at least one exhaust gas pipe, and preferably in the adjoining area of two jacket shells. A mutual interference of the jacket shells with one or more such exhaust gas pipes can thus be avoided.

In a configuration that is advantageous in terms of thermal load, the jacket shells may be configured as shaped sheet metal parts. With the jacket shells configured as shaped sheet metal parts, it is possible in an especially simple manner to provide the at least one air guiding bulge by integration into at least one jacket shell.

In order to be able to further reduce the generation of flow noises in the area of the at least one air guiding bulge, it is proposed that at least one air guiding bulge be closed in the direction of the housing longitudinal axis.

For an efficient air guiding characteristic, at least one air guiding bulge may extend in the direction of the housing longitudinal axis essentially along the entire muffler housing.

A muffling effect generated by the enclosing of the muffler housing with the housing jacket can be used in an intensified manner when the housing jacket encloses the muffler housing with insertion of a layer of insulating material or/and with formation of a gap-like (gap) intermediate space.

For introducing a defined air guiding effect, it is proposed that the housing jacket have a greater distance to the muffler housing in the area of the at least one air guiding bulge than in areas adjacent to the at least one air guiding bulge, preferably such that the distance between the housing jacket and the muffler housing increases up to a maximum distance in the area of the at least one air guiding bulge, starting from the areas adjacent to the at least one air guiding bulge.

The present invention further pertains to a housing jacket for enclosing a muffler, preferably for a muffler assembly unit having the configuration according to the present invention, comprising at least two jacket shells to be connected to one another in connecting edge areas to be positioned adjacent to one another, and at least one air guiding bulge is provided on at least one jacket shell.

It should be pointed out that such a housing jacket may be configured with individual features, a plurality of features or all features described above in reference to a muffler assembly unit, specific for the housing jacket thereof.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 3:
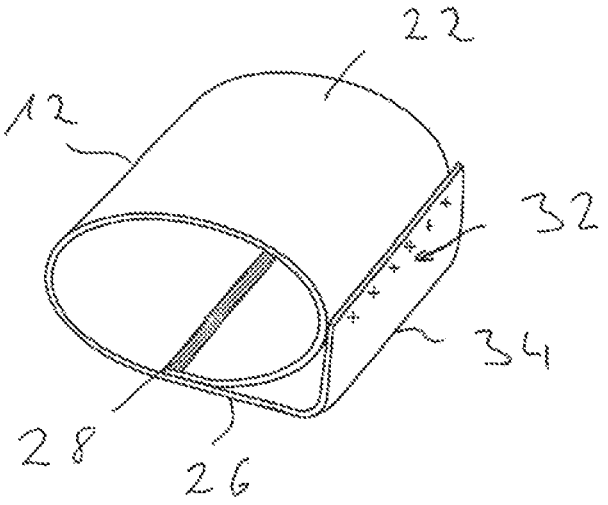
FIG. 3 is a perspective view showing the circumferential wall from FIG. 2 configured with an air guiding bulge as an integral component of same.
Figure 4:
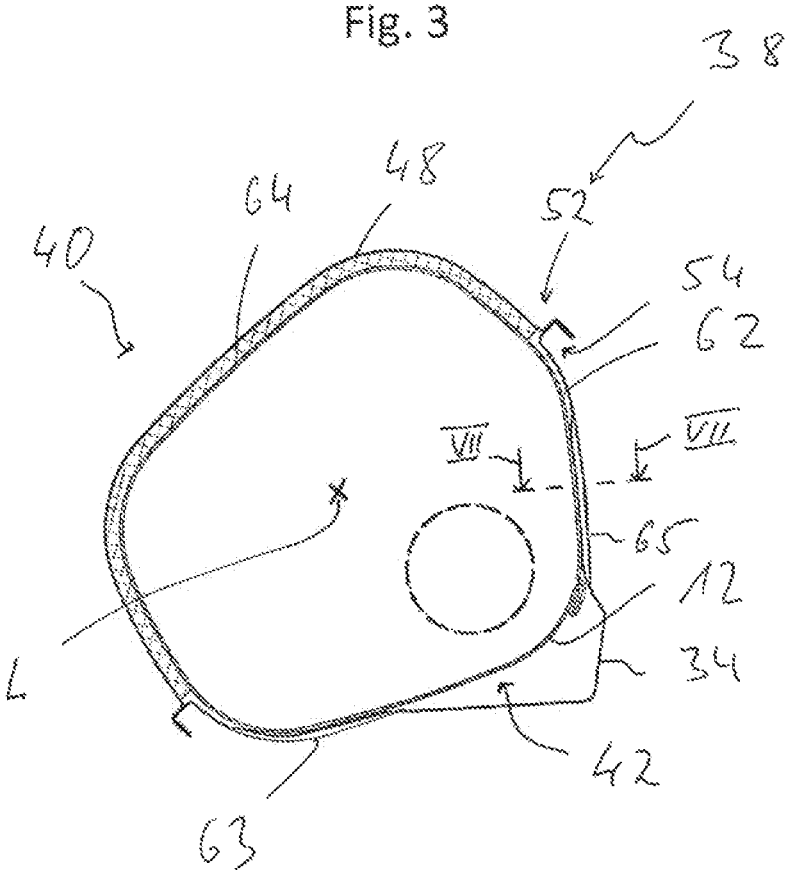
FIG. 4 is cross sectional view of a muffler assembly unit configured according to the principles of the present invention.
Figure 5:
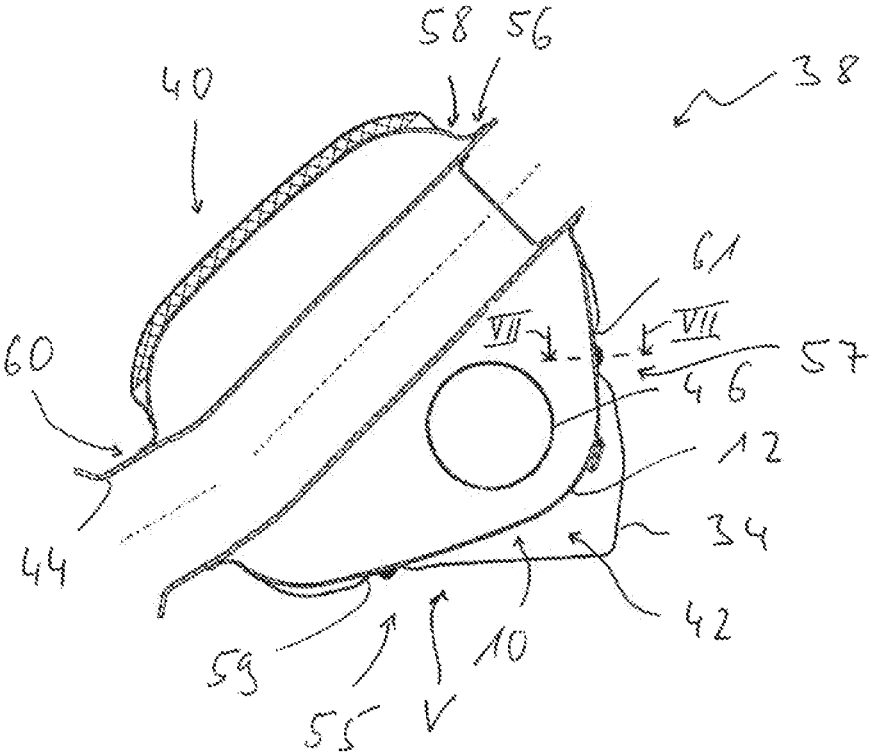
FIG. 5 is another cross-sectional view of the muffler assembly unit from FIG. 4, cut in a longitudinal central area.
Figure 6:
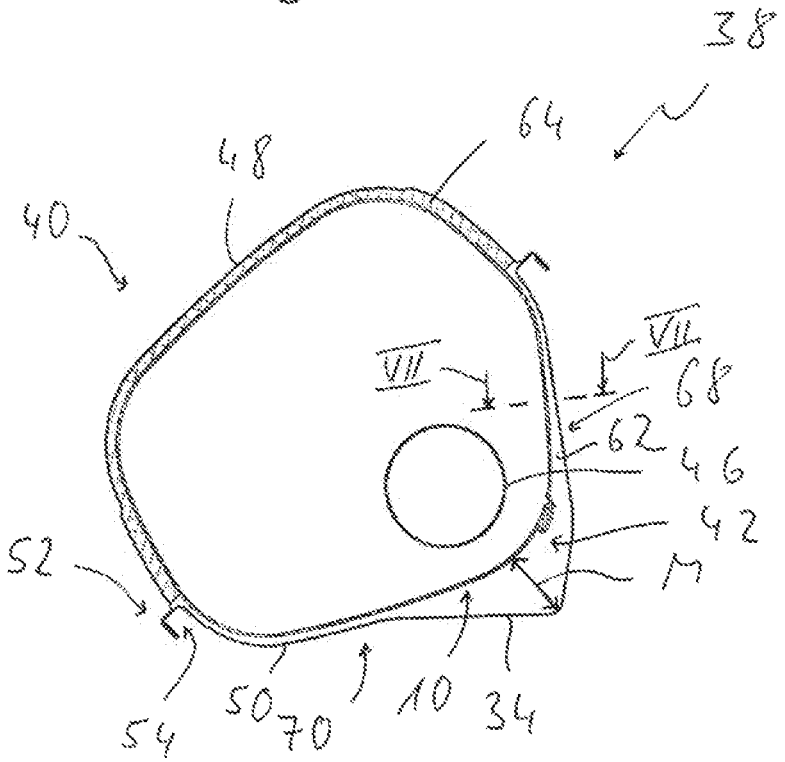
FIG. 6 is another cross-sectional view of the muffler assembly unit from FIG. 4.
Figure 7:
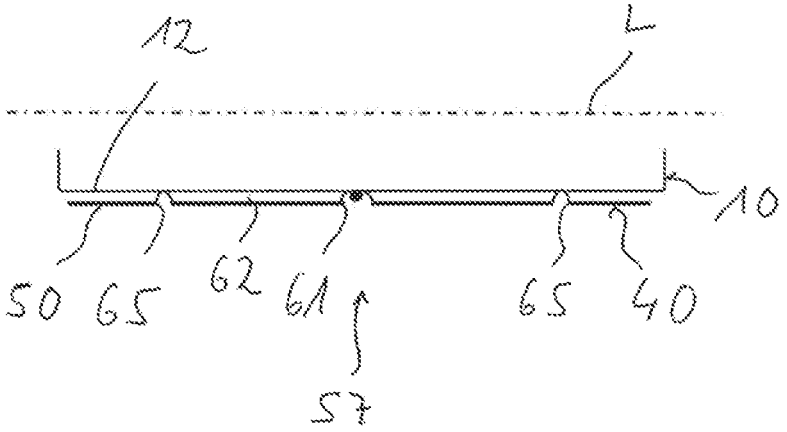
FIG. 7 is a principal longitudinal sectional view of the muffler assembly unit along a plane VII-VII shown in FIGS. 4 to 6.

Referring to the drawings, FIGS. 4-6 show in various section planes cross-sectional views of a muffler assembly unit 38 with a muffler 42 enclosed by a housing jacket 40. It should be pointed out that the muffler 42 may be, in principle, configured as described above with reference to FIGS. 1-3. The muffler 42 may thus have a muffler housing, which is generally designated by 10, with a circumferential wall 12 formed, for example, by rolling a sheet metal body and with a front wall each at both axial ends of same. One or more intermediate walls, which form chambers communicating with one another or possibly also separated from one another, may be provided in the interior of the muffler housing 10.

Exhaust gas can be introduced into the muffler 42 via an exhaust gas pipe 44 protruding through the circumferential wall 12, which exhaust gas pipe may form, for example, an inlet pipe. For example, two or more exhaust gas pipes 44 forming such inlet pipes may be provided at a distance from one another in the direction of the housing longitudinal axis L of the muffler housing 10, which housing longitudinal axis is at right angles to the drawing plane of FIG. 4. The exhaust gas can be discharged to the surrounding area or into parts of an exhaust system following downstream via an exhaust gas pipe 46 traversing one of the front walls and, if present, one or more of the intermediate walls, which exhaust gas pipe may then form, for example, an outlet pipe.

The housing jacket 40 encloses the muffler 10 in an entire circumferential area. The housing jacket 40 is configured with two jacket shells 48, 50. Where the two jacket shells 48, 50 adjoin one another, these jacket shells 48, 50, which are provided as shaped sheet metal parts, are arranged adjoining one another with a connecting edge area 52, 54, which is, for example, bent outwards and, e.g., permanently connected to one another by crimping or/and welding.

The jacket shells 48, 50 are, in principle, adapted in their shape to the outer contour of the muffler housing 10. Thus, it can be seen, for example, that in an area, in which a housing bulge 56 is provided on the muffler housing 10 for connecting the exhaust gas pipe 44, the jacket shells 48, 50 enclosing the muffler housing 10 in this area form a corresponding receiving opening 58. As an alternative, a receiving bulge overlapping the muffler housing and receiving the housing bulge 56 thereof in this area could be formed in the housing jacket 40.

In the area, in which the exhaust gas pipe 44 protrudes outwards from the muffler housing 10, an exhaust gas pipe passage opening 60 allowing the passage of the exhaust gas pipe 44, for example, adapted to the circumferential contour thereof, is provided in the housing jacket 40 in the area in which the two jacket shells 48, 50 adjoin one another. For example, if the exhaust pipe 44 has a circular configuration, a semicircular part of this exhaust gas pipe passage opening 60 can be formed in each of the two jacket shells 48, 50.

The housing jacket 40 may be configured, for example, such that the housing jacket 40 encloses the muffler housing 10 essentially only in the area of the circumferential wall 12 thereof, so that this muffler housing 10 is exposed outwards in the axial end areas, especially in the area of the front walls of the muffler housing 10. For a full enclosure of the muffler 42 or of the muffler housing 10, the jacket shells 48, 50 may, however, also be shaped such that they overlap this muffler housing at the axial end areas of the muffler housing 10 and thus also fully overlap the front walls. The connecting edge areas 52, 54 in case of such a configuration are configured as essentially all-around edge areas, which are possibly only interrupted where an exhaust gas pipe passage opening or a receiving opening is formed.

For the permanent connection of the housing jacket 40 to the muffler housing 10, the housing jacket 40 is connected, e.g., by spot welding, to the muffler housing 10, especially to the circumferential wall 12 at some connection areas 55, 57. In order to avoid a direct contact in other areas and thus vibration noises possibly generated thereby, for example, the housing jacket 40 may be configured in some areas of the jacket shells 48, 50 with base-like or arch-like bulges 59, 61, protruding inwards, i.e., in the direction towards the muffler housing 10, which bulges are present on the outer surface of the muffler housing 10 and are connected in substance there to this muffler housing. A gap-like (gap) intermediate space 62, which generates an additional muffling effect, can thus be provided between the muffler housing 10 and the housing jacket 40. This intermediate space 62 may be filled with a layer of insulating material 64 enclosing the muffler housing 10 on its outer side, which insulating material may lead to a further improvement of the muffling characteristic or/and to a thermal insulation. Such fibrous or foam-like insulating material may be used here, as is also used in the interior of mufflers for lining chambers formed in same.

It can be seen in FIGS. 4-6 that in the example shown, such insulating material 64 is essentially provided only between the housing shell 48 and the muffler housing 10, while the gap-like intermediate space 62 between the housing shell 50 and the muffler housing 10 is not filled with insulating material. Likewise, the housing jacket 40 is fixed to the muffler housing 10 only in the area of the housing shell 50 in the connection areas 55, 57 or by rib-like support areas 63, 65, which can be seen in FIG. 4, supported on the outer side of the muffler housing 10, but without being fixed there. Furthermore, a support of the housing jacket 40 in relation to the muffler housing may take place where an exhaust gas pipe passage opening is provided for guiding through an exhaust gas pipe or a receiving opening for receiving a bulge of the muffler housing 10. However, it should be pointed out that insulating material 64 may, in addition or as an alternative, be provided in the area between the jacket shell 50 and the muffler housing 10, or/and that, as an alternative or in addition, the jacket shell 48 may also be permanently connected to the muffler housing 10 or/and be supported in additional support areas in relation to this muffler housing 10.

In order to allow different thermal expansions of the muffler housing 10, on the one hand, and the housing jacket 40, on the other hand, when the muffler assembly unit 38 is heated, all connection areas 59, 61 are preferably arranged in a connecting length area V, i.e., in the same length area in the direction of the housing longitudinal axis L, while the housing jacket 40 is not permanently connected to the muffler housing and thus can expand from this muffler housing 12 when heated, starting from this connecting length area V, in the direction towards the axial ends. The length area, in which the housing jacket 40 is fixed to the muffler housing 10, may be, for example, a longitudinal central area of the housing jacket 40 or of the muffler housing 10, in order to provide sections of the housing jacket 40 of approximately the same length at both end areas, which sections are not fixed to the muffler housing 10.

It can be clearly seen in FIG. 4 that an air guiding bulge 34 extending, for example, essentially over the entire axial length of the muffler housing 10 is formed in a circumferential area of the jacket shell 50 of the housing jacket 40. The air guiding bulge 34 is integrated into the jacket shell 50 and provides in its circumferential expansion area an outer contour of the muffler assembly unit 38, which outer contour deviates from the circumferential contour of the muffler housing 10 and provides a defined air guiding. While the housing jacket 40 has a distance to the muffler housing 10 that is essentially uniform over the circumference in the areas 68, 70 adjacent to the air guiding bulge 34, except for the connection areas 55, 57 or/and the support areas 63, 65, the distance of the jacket shell 50 from the muffler housing 10, especially from the circumferential wall 12 of same, increases up to a maximum value M in the area of the air guiding bulge 34, so that where, for example, the circumferential wall 12 has a circumferential contour curved with a greater radius of curvature, the air guiding opening 34 provides a circumferential contour that is approximately angular or is curved with a markedly smaller radius of curvature.

Figure 1:
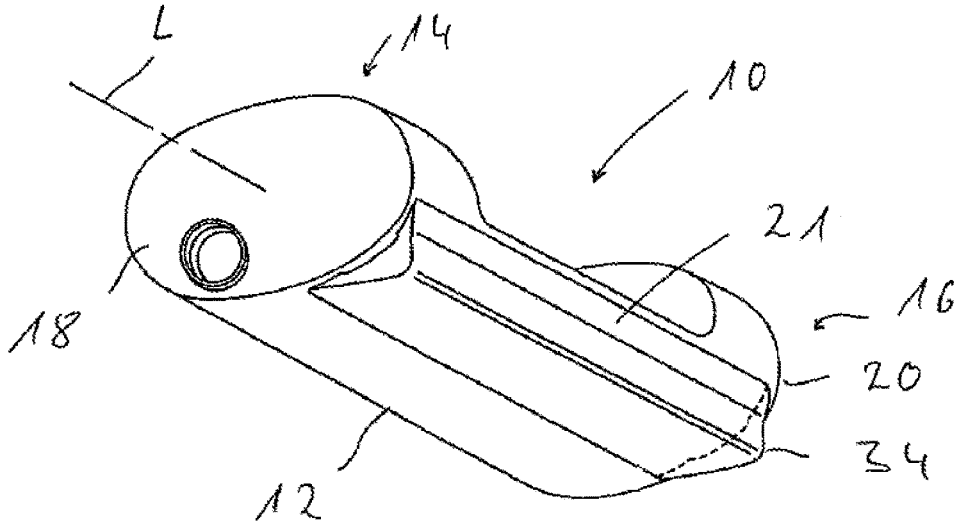
FIG. 1 is a perspective view showing a muffler housing known from the state of the art.
Figure 2:
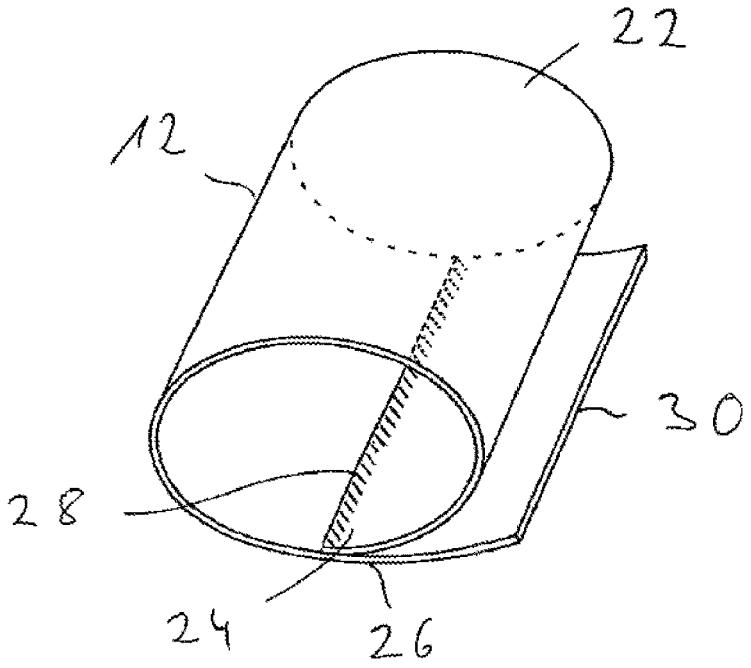
FIG. 2 is a perspective view showing a circumferential wall for a muffler housing, which circumferential wall is formed by rolling a sheet metal body, known from the state of the art.

The air guiding bulge 34 may, as this is shown in FIGS. 1-3 with reference to the state of the art, extend in the direction of the housing longitudinal axis L essentially along the entire circumferential wall 12 or of the entire muffler 42. In principle, the air guiding bulge 34 could also be interrupted in the direction of the housing longitudinal axis, or/and a plurality of air guiding bulges following one another in the circumferential direction could be provided. Since the air guiding bulge 34 is integrated into the housing jacket 40, this housing jacket 12 may be configured as closed in its axial end areas or at least in one axial end area, so that essentially a duct extending along the outer side of the muffler housing 10 and through which air can flow is not formed. Such a shape, for example, of the jacket shell 50 can be achieved by deep-drawing of a plate-like sheet metal blank in a correspondingly shaped deep-drawing mold and can also especially be provided if the housing jacket 40 overlaps the muffler 42 even at its axial end areas, i.e., in the area of its front walls. In case of a configuration, in which the housing jacket 40 is configured as essentially only overlapping the circumferential wall 12 of the muffler housing 10, the duct formed by the provision of the air guiding bulge 34 could be produced by closing elements inserted into the air guiding bulge 34 and fixed, for example, by soldering or welding in axial end areas of the jacket shell 50 on the inner side.

Further, the housing jacket 40 could have a one-piece configuration and, fully enclosing the circumferential wall of the muffler housing, have connecting edge areas that are positioned adjoining one another in a circumferential area and are to be connected to one another.

In case of the configuration of a muffler assembly unit according to the present invention, due to the enclosing of the muffler housing 10 with a housing jacket 40, it is made possible to provide a geometry that is entirely independent from the configuration of a muffler itself in terms of a shape and dimensions for the guiding of the air flowing about the muffler. The housing jacket 40 provides, furthermore, the possibility to introduce an additional thermal or/and acoustic insulation, and can especially expand uncoupled from the muffler itself in case of thermal load, so that there is no risk of a deformation or an excessive load in the areas, in which the formation provided for the defined guiding of air is fixed to the muffler housing 12.

While specific embodiments of the invention have been shown and described in detail to illustrate the application of the principles of the invention, it will be understood that the invention may be embodied otherwise without departing from such principles.

What is claimed is:

1. A muffler assembly unit for an exhaust system of an internal combustion engine, the muffler assembly unit comprising:

a muffler comprising a muffler housing that is elongated along a housing longitudinal axis;

a housing jacket enclosing the muffler housing; and at least one air guiding bulge provided on the housing jacket, wherein:

the housing jacket has at least one rib support area and is supported on an outer side of the muffler housing in the at least one rib support area without being fixed there to the muffler housing; and the housing jacket is permanently connected to the muffler housing by welding only at a plurality of connection areas positioned in the same length area in a direction of the housing longitudinal axis in a connecting length area in a longitudinal center in the direction of the housing longitudinal axis of the muffler housing, and wherein the housing jacket is not permanently connected to the muffler housing starting from the connecting length area in the direction towards axial end areas of the housing jacket for providing housing jacket sections of substantially similar length extending from the connecting length area to both axial end areas of the housing jacket that are not fixed to the muffler housing.

2. The muffler assembly unit in accordance with claim 1, wherein the muffler housing comprises:

a circumferential wall that is elongated in a direction of the longitudinal axis of the housing; and front walls, one of the front walls being disposed at each of both axial end areas of the circumferential wall, wherein the housing jacket fully encloses the circumferential wall in at least one length area of same.

3. The muffler assembly unit in accordance with claim 2, wherein:

the housing jacket fully encloses the circumferential wall essentially in an entire length area; or the housing jacket overlaps at least one front wall; or the housing jacket fully encloses the circumferential wall essentially in an entire length area and the housing jacket overlaps at least one front wall.

4. The muffler assembly unit in accordance with claim 1, wherein:

the housing jacket comprises at least two jacket shells connected to one another; and the at least one air guiding bulge is provided on at least one jacket shell of the at least two jacket shells.

5. The muffler assembly unit in accordance with claim 4, wherein:

the two jacket shells are connected to one another by connection in substance; or the two jacket shells are positive locking connected in connecting edge areas adjoining one another; or at least one jacket shell is permanently connected, by a connection in substance, to the muffler housing; or any combination of the two jacket shells are connected to one another by connection in substance and the two jacket shells are positive locking connected in connecting edge areas adjoining one another and at least one jacket shell is permanently connected, by a connection in substance, to the muffler housing.

6. The muffler assembly unit in accordance with claim 4, wherein:

the jacket shells are configured as shaped sheet metal parts; and the at least one air guiding bulge is integrated into at least one of the jacket shells.

7. The muffler assembly unit in accordance with claim 1, wherein:

the muffler housing comprises at least one housing bulge; and the housing jacket has a receiving opening or receiving bulge or receiving opening and receiving bulge receiving the housing bulge in at least some areas in association with the at least one housing bulge.

8. The muffler assembly unit in accordance with claim 1, further comprising at least one exhaust gas pipe projecting from the muffler housing, wherein the housing jacket has an exhaust gas pipe passage opening in an area of the at least one exhaust gas pipe and in an adjoining area of the two jacket shells.

9. The muffler assembly unit in accordance with claim 1, wherein the at least one air guiding bulge is closed in a direction of the housing longitudinal axis.

10. The muffler assembly unit in accordance with claim 1, wherein the at least one air guiding bulge extends in a direction of the housing longitudinal axis essentially along an entirety of the muffler housing.

11. The muffler assembly unit in accordance with claim 1, wherein:

the housing jacket encloses the muffler housing and cooperates with the muffler housing to define a gap intermediate space; and a layer of insulating material is disposed in the gap intermediate space or the gap intermediate space is not filled.

12. The muffler assembly unit in accordance with claim 1, wherein:

the housing jacket has a greater distance to the muffler housing in an area of the at least one air guiding bulge than in areas adjacent to the at least one air guiding bulge, whereby a distance between the housing jacket and the muffler housing increases up to a maximum distance in the area of the at least one air guiding bulge, starting from the areas adjacent to the at least one air guiding bulge.

13. An assembly unit for an exhaust system of an internal combustion engine, the assembly unit comprising:

an exhaust housing elongated along a longitudinal axis;

a housing jacket enclosing said exhaust housing, said housing jacket having an air guiding bulge relative to said exhaust housing;

a plurality of connection areas fixing said housing jacket to said exhaust housing, each of said plurality of connection areas being positioned at a central longitudinal position of said exhaust housing, said housing jacket not being longitudinally fixed to said exhaust housing at longitudinal positions spaced from said central longitudinal position.

14. An assembly unit in accordance with claim 13, wherein:

said housing jacket has axial ends, said central longitudinal position being arranged equally distanced from said axial ends of said housing jacket.

15. An assembly unit in accordance with claim 14, wherein:

a muffler is arranged in said exhaust housing.

16. An assembly unit in accordance with claim 13, wherein:

a muffler is arranged in said exhaust housing.

17. An assembly unit in accordance with claim 16, wherein:

said plurality of connection areas are arranged at a single longitudinal position of said exhaust housing.

18. An assembly unit in accordance with claim 13, wherein:

said plurality of connection areas are arranged at a single longitudinal position of said exhaust housing.

* * * * *